US005432986A

United States Patent [19]

Sexton

[11] Patent Number: 5,432,986

[45] Date of Patent: Jul. 18, 1995

[54] MAGNETIC FASTENER

[76] Inventor: Jason Sexton, 2700 Peterson Pl., #28B, Costa Mesa, Calif. 92626

[21] Appl. No.: 77,836

[22] Filed: Jun. 15, 1993

[51] Int. Cl.[6] ..... A44B 21/00

[52] U.S. Cl. ..... 24/303

[58] Field of Search ..... 24/303, 590; 335/285; 248/206.5; 292/251.5

[56] References Cited

U.S. PATENT DOCUMENTS

| | | | |
|---|---|---|---|
| 2,176,052 | 10/1939 | Beyer | 24/303 X |
| 2,615,227 | 11/1949 | Hornik . | |
| 2,648,884 | 12/1949 | Loofboro . | |
| 2,954,874 | 2/1957 | Rouse . | |
| 3,086,268 | 4/1963 | Chaffin, Jr. | 24/303 |
| 3,129,477 | 6/1962 | Mizuno . | |
| 3,293,714 | 12/1966 | Shater | 24/303 |
| 3,589,341 | 6/1971 | Krebs | 24/303 X |
| 4,231,137 | 11/1980 | Fujimoto | 24/303 |
| 4,458,396 | 7/1984 | Aoki . | |
| 4;875,654 | 2/1989 | Chandonnet et al. . | |
| 4,901,299 | 2/1990 | Grover et al. . | |
| 4,982,581 | 1/1991 | Furuyama | 24/303 X |
| 4,989,299 | 2/1991 | Morita . | |
| 5,042,116 | 8/1991 | Ossiani . | |
| 5,099,659 | 3/1992 | Carranza et al. . | |

FOREIGN PATENT DOCUMENTS

| | | | |
|---|---|---|---|
| 2569337 | 2/1986 | France | 24/590 |

*Primary Examiner*—James R. Brittain

*Attorney, Agent, or Firm*—Price, Gess & Ubell

[57] ABSTRACT

A magnetic fastener for jewelry, belts, to replace buttons or use in any similar applications wherein two members, each containing a surface of magnetic material, interlock so that the surfaces are held in contact by magnetic attraction when the fastener is closed, creating a low-profile structure that appears to be of a single piece, with one of the members provided with a tab to allow grasping that member for opening the fastener.

14 Claims, 3 Drawing Sheets

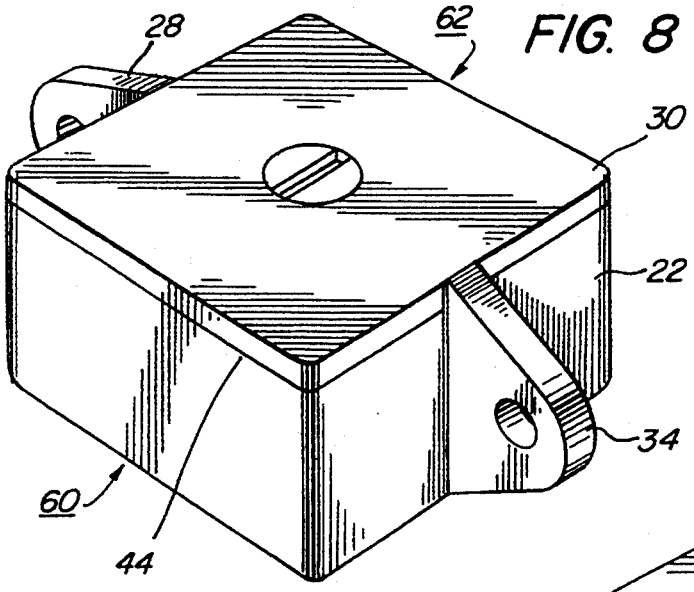
FIG. 8
FIG. 7
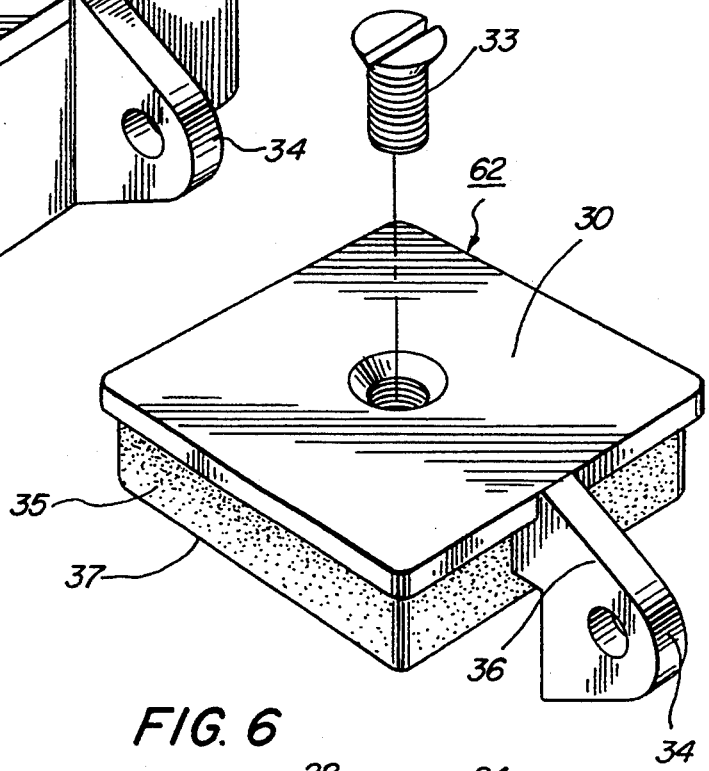
FIG. 6
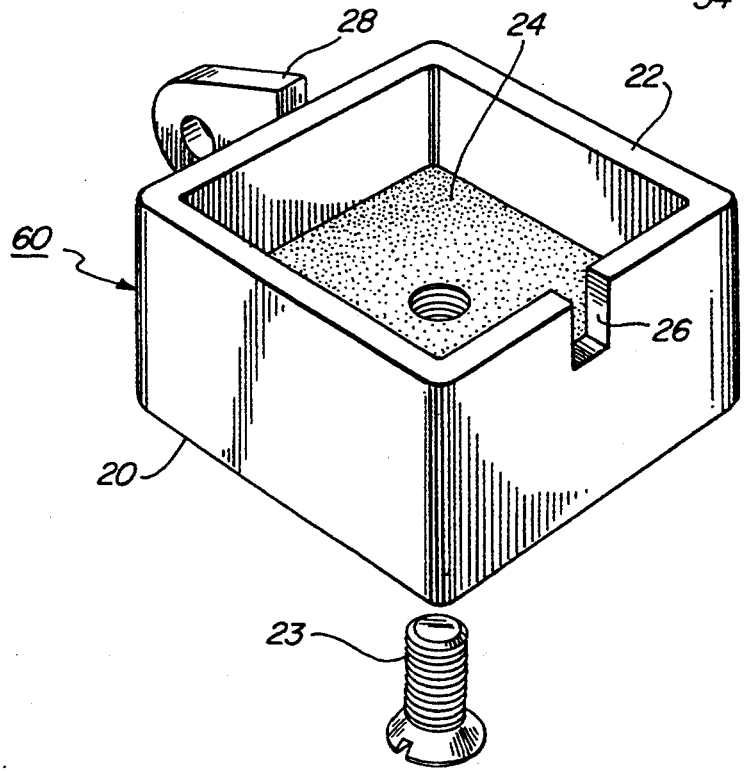

MAGNETIC FASTENER

BACKGROUND OF THE INVENTION

1. Field of the Invention

The present invention relates to a fastener or coupling means that uses the attraction of a permanent magnet. Jewelry, clothing, and other objects often require the use of a device that allows two objects, such as the ends of a necklace or a belt, to be repeatedly fastened and unfastened. Such a device can be called a fastener.

2. Description of Related Art

A great variety of fasteners exist in the prior art. The most common form of a fastening device is mechanical, such as a hook-and-eye combination to fasten the ends of a necklace.

However, magnetic fasteners are also known in the prior art. The typical magnetic fastener comprises two parts, each of which contains surfaces of magnetic material. In some magnetic fasteners one part contains a magnetic material that will be attracted to a permanent magnet in the other part. Other fasteners contain permanent magnets in both parts. The use of two magnets produces a stronger attraction, allowing smaller-sized devices, but at a somewhat greater manufacturing cost. In either case, the attractive force is strongest in a direction perpendicular to the contacting surfaces of the magnetic material. Thus, the fastener would be difficult to separate by a force exerted perpendicular to the surface, but would be easily separated by a force applied parallel to the surface. That is to say, the fastener parts could be easily slid apart. This is not a desirable property in a device intended to secure valuable jewelry.

The prior art has dealt with the problem that the weak parallel attraction of the fastener may permit accidental unfastening. Various mechanical structures have been used to limit motion of the magnetic surfaces in a parallel direction. An early example is U.S. Pat. No. 2,648,884 to Loofboro. There, the inventor provides a complex tongue-in-groove structure on the magnetic surfaces to prevent a sliding movement along the surfaces. U.S. Pat. No. 2,615,227 to Hornik utilizes a complex dove-tailing structure to prevent inadvertent sliding of the magnetic surfaces.

Many recent inventions have used a pin-in-hole structure to prevent the unwanted sliding of the surfaces. A good example is U.S. Pat. No. 4,989,299 to Morita, which describes a jewelry clasp in which one member of the clasp is a permanent magnet with a hole and the other member is a plate of magnetic material that has a projection that is inserted into the hole to fasten the clasp. This pin-in-hole design serves the same purpose as the dovetailing in the earlier art: it prevents lateral forces from opening the fastener by causing the fastener members to slide along the magnetic surfaces. A similar solution to the sliding problem is used in U.S. Pat. No. 5,042,116 to Ossiani, where a pin-in-hole structure is used to prevent sliding in a magnetic button for handbags and garments. The design is somewhat complex, showing a second pin that fits into the first pin as that pin fits into a hole in a magnet.

Apart from the matter of accidental unfastening, a second matter of concern is the absolute size of the fastener. Many designs are relatively large. This is not a drawback for button fasteners on purses and similar goods. However, a clasp for use on a necklace or other delicate jewelry must be small and of low profile. It is important that the parts of the clasp go together to produce a small and attractive looking structure. Many prior art designs are either too large or present structures that are not, in themselves, attractive from a jewelry perspective.

Prior magnetic fasteners also suffer from the problem of being difficult to unfasten. The very structures that prevent accidental unfastening by sliding parallel to the magnetic surfaces require that the clasp be unfastened only by applying force perpendicular to the magnetic surfaces. This is not too difficult in the case of a button fastener, where force may be readily applied by pulling the fabric to which the fastener is attached. The unfastening problem is greater with a jewelry clasp where the clasp is attached to a fine chain: attempts to apply significant force by pulling the chain may result in breaking the chain. The problem is especially acute when the fastener is tiny and of low-profile as is desirable with jewelry. This problem has not been adequately resolved by the prior art.

SUMMARY OF THE INVENTION

An object of the present invention is to provide a simple magnetic fastener for use on necklaces, similar jewelry, and in place of belt buckles and buttons.

It is a further object of the present invention to provide a clasp that is small and of low profile so that it does not detract from the overall design of the object to be fastened.

An additional object is to provide a fastening structure that is secure from accidental unfastening, but can be readily unfastened when desired.

These objects are attained by providing a magnetic fastener of two elements. Each element contains a substantially flat magnetic surface. When the fastener is closed, the magnetic surfaces of the two elements are in contact. Both elements may contain a magnetic surface that is a permanent magnet. In this case, the magnetic poles are oriented so that when the fastener is fastened, the magnetic north pole of one element is in contact with the magnetic south pole of the other element. Alternately, one element may contain a permanent magnet and the other element may contain ferromagnetic material that is attracted to the magnet. As is apparent to one skilled in the art, this choice will be based on a tradeoff between cost and desired size of the fastener. A device that uses two magnets may be somewhat more expensive to produce, but can be smaller because two magnets produce a greater attractive force than does one magnet and a ferromagnetic surface.

The first element of the fastener is a receiving member that comprises a more or less flat base with a peripheral wall around the edge of the base and perpendicular to the base. This structure is shown as being rectangular, but can readily be round or polygonal or any other shape that is in harmony with the jewelry or other object to be fastened. The wall produces a recess in which one of the magnetic surfaces is located. Typically, means to attach the item to be fastened is located at one end of the receiving member. For example, in the case of a necklace clasp, the means would be an eye for attaching the chain. In the case of a belt buckle, the attachment means could be a slot for attaching the leather of the belt. Opposite the attachment point is a notch in the wall into which will receive the attachment means for the other half of the fastener when the device is fastened. However, in the case of button-type fasteners the attachment means may be on the base of either or both the receiving and insertion members. Depending on the orientation of the attachment means of the receiving member, there may be two, rather than a single notch.

The second element of the fastener is an inserting member that comprises a more or less flat base that is approximately the same size and shape as the outline of the recess on the receiving member. On one surface of the base is the second magnetic surface. This surface is sized so that it can fit within the recess of the receiving member. Typically, means to attach the item to be fastened is located at one point along the periphery of the base. Again, this may be an eye or a slot as is needed. This attachment structure is sized to fit within and pass through the notch in the wall of the receiving member when the inserting member is inserted into the receiving member. In addition, the attachment structure bears a tab or other elaboration to allow one to securely grasp the inserting member when exerting force to unfasten the device.

In the case of a button-type fastener, the attachment means may be located centrally on the base of the inserting member. In that case, the notch on the receiving member would receive only the tab. Alternatively, in a button-type fastener the attachment means might be located along the periphery of the base approximately opposite the tab. In this case, the receiving member would advantageously have two notches: one for the tab; and one for the attachment means.

The fastener is closed by inserting the inserting member into the receiving member. The magnetic surface of the inserting element fits into the recess of the receiving element and the two magnetic surfaces come into contact thus holding the device in the fastened position. In that position the attachment structure of the inserting member passes through the notch in the wall of the receiving element. This provides an interlocking, low-profile fastener. The base of the inserting member is just large enough to overlap the top of the walls of the receiving member. This produces a low-profile object that looks like a single piece. Alternatively, the base of the inserting member may be sized to just fit within the recess, leaving the top of the walls of the receiving member exposed and flush with the base of the inserting member when the fastener is fastened. The invention is described with the receiving member on the bottom and the inserting member on the top. One skilled in the art will realize that these positions may be reversed.

Because the inserting member fits within the recess of the receiving member, the walls of the receiving member prevent any sliding motion in a direction parallel to the magnetic surfaces, thus preventing accidental unfastening. The notch or notches allow the attachment means and tab to securely interlock with the receiving member wall in a low-profile position. The notch also serves as an orientation device and limits twisting of the fastener, especially in button-type uses. The clasp is unfastened by exerting a force perpendicular to the magnetic surfaces. The exterior of the receiving member is grasped with the fingers of one hand. The fingers of the other hand grasp the tab or elaboration attached to the inserting member. A gentle force releases the fastener. In button-type applications the force may be applied by grasping the fabric or, depending on the exact design, using the tab.

The magnetic surfaces may be provided by manufacturing the receiving member, the inserting member, or both, out of suitable magnetic substances. Alternatively, appropriately-shaped pieces of magnetic material can be attached to receiving and inserting members made out of precious metals or other appropriate materials. The magnetic material can be attached with adhesive or by use of a screw or a rivet or other mechanical fastening means. In button-type applications a rivet can advantageously be used to simultaneously attach the fabric to one surface of the base and the magnetic material to the other surface of the base.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

FIG. 6 is a perspective view of a receiving member;

FIG. 7 is a perspective view of an inserting member; and

FIG. 8 is a perspective view of the members of FIGS. 6 and 7, forming a closed fastener.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a low-profile magnetic fastener that fastens securely and has means for ready unfastening.

Figure 1:
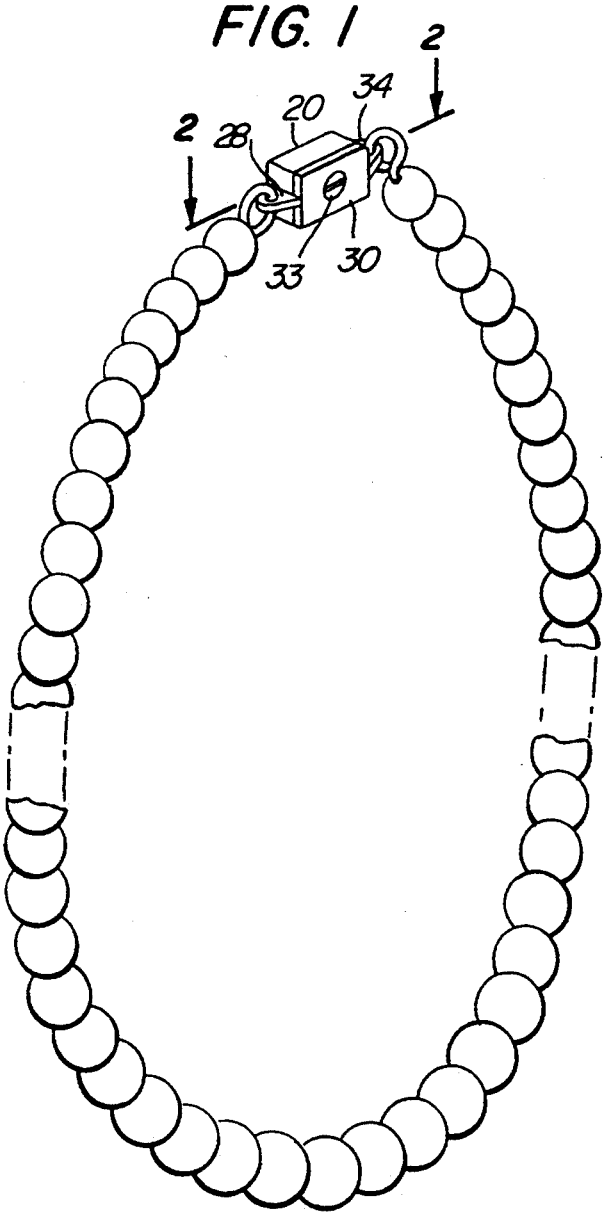
FIG. 1 is a perspective view of the present invention used as a necklace clasp.
Figure 2:
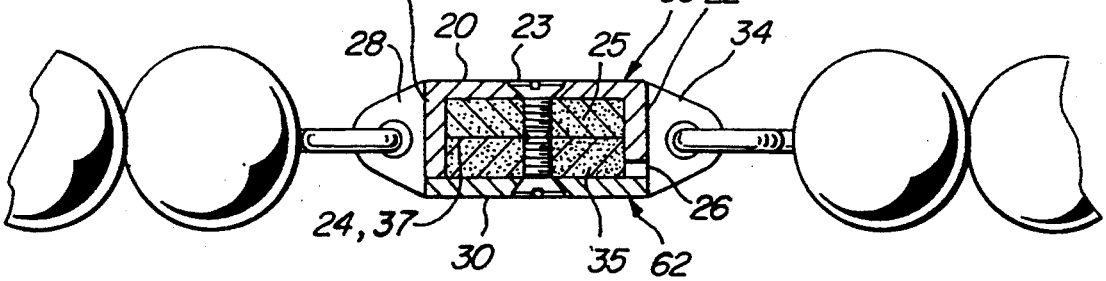
FIG. 2 is a cross-section view of the necklace clasp of FIG. 1 taken along line 2–2 with the receiving member on the top.

Referring to the drawings, FIG. 1 shows the magnetic fastener being used as a clasp on a necklace. FIG. 2 displays a cross-section of this clasp showing the receiving member 60 and the inserting member 62. FIG. 6 illustrates a perspective view of the receiving member 60. In the preferred embodiment the receiving member 60 and the inserting member 62 are constructed out of precious metal, such as a gold alloy, compatible with the item (i.e. necklace) to be fastened. Alternatively, a base metal or other inexpensive material can be used; in such a case a finished plating of precious metal or other diversified finishes can advantageously be applied. The receiving member 60 has a base 20 in the form of a relatively thin sheet of the precious metal. A wall 22 is attached to the periphery of the base 20 and extends substantially perpendicularly from the base 20 to form an open-topped box having a recessed area. The wall 22 and the base 20 can be cast as a single piece according to well-known techniques. Within the box-shaped recessed area created by the walls is a contacting surface 24.

As shown in FIG. 2, the contacting surface 24 is one surface of a wafer of magnetic material 25. The wafer 25 is sized to fit within the recess of the wall 22, and its thickness is approximately one-half the height of the wall 22. The wafer 25 is preferably attached to the base 20 with a screw 23. At one end of the receiving member 60 is an attachment means 28, in this case an eyelet for attaching a fine necklace chain. At the opposite end of the receiving member is notch 26, through which will pass an attachment means 34 of the inserting member 62 when the clasp is in the fastened position.

FIG. 7 shows a perspective view of the inserting member 62. Like the receiving member 60, the inserting member 62 has a base 30, preferably made of the same alloy as the receiving member base and walls. FIG. 2 shows that a wafer of magnetic material 35 is attached to one surface of the base 30 with a screw 33. The wafer 25 is sized so that it will just fit within the recess created by the wall 22 of the receiving member. The thickness of the wafer 25 is selected so that the inserting member surface 34 will contact the receiving member surface 24 when the clasp is in the fastened position. At the same time the inserting member base 30 will just contact the top of the receiving member wall 22. At one end of the inserting member 62 is the attachment means 34 (here an eyelet to attach a necklace chain) integral with a tab member 36, which is provided to readily grasp the inserting member 62 when the clasp is in the fastened position.

It will be appreciated that the height of the receiving member wall 22 is controlled by the thickness of the magnetic materials used for the contacting surfaces 24, 37 of the inserting and receiving members 60, 62. The object is to produce a small clasp with a low profile. Generally, the height of the receiving member wall 22 will be much less than the length or width of the receiving member base 20. However, this parameter can be readily manipulated to attain different fashion goals.

To close the fastener, the inserting member 62 is inserted into the receiving member 60 so that wafer 35 goes into the recess of the receiving member 60. Tab 36 passes through the notch 26 when the pieces are correctly oriented. Magnetic attraction will cause the pieces to snap together, and the closed fastener presents the appearance of a single unit, as shown in FIG. 8. When the surface 37 comes into contact with the surface 24, the base 30 comes into contact with the wall 22 to create a seam 44, see FIG. 8. Tab 36 passes through notch 26, also giving the appearance that the two members are now a single unit. To unfasten the clasp one first grasps the receiving member 60 between the thumb and forefinger of one hand. The inserting member tab 36 is then grasped with the other hand and a gentle pull separates the two members.

Figure 4:
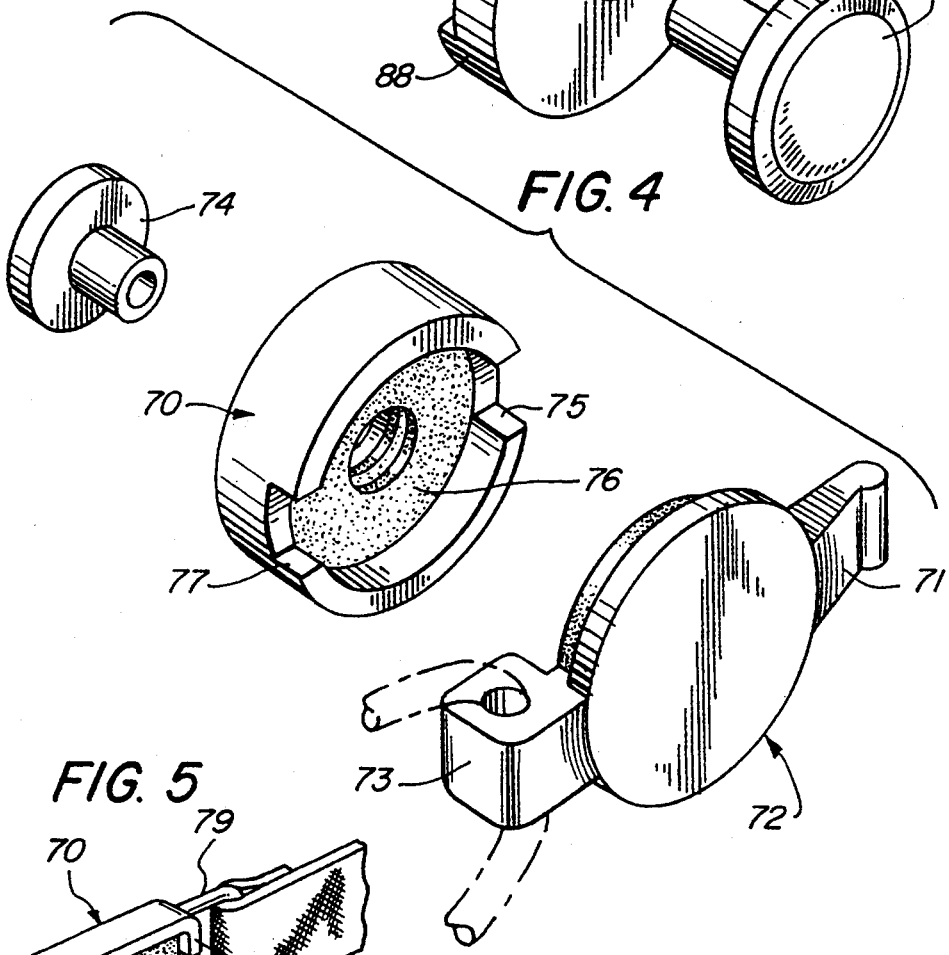
FIG. 4 is a perspective view of the present invention used as a button-type fastener with a different configuration than FIG. 3.

FIG. 4 shows a slightly different embodiment which uses the invention in the place of a button-type fastener. A receiving member 70 is attached to a piece of fabric or leather (not shown) which is sandwiched between a base of the receiving member 70 and a rivet 74. The rivet 74 serves as the external attachment means for the receiving member 70. The rivet 74 also penetrates through a hole in magnet surface 76 and serves to attach the magnetic wafer to the base. The receiving unit 70 is unlike that of FIG. 6 in that it has two notches 75, 77, rather than a single notch 26. An inserting member 72 differs from the inserting member 62 in FIG. 7, and its integral attachment means 36 and tab 34, in that a tab member 71 is separated from, rather than integral with, an external attachment means 73. The attachment means 73 is used to attach the fastener to the edge of a piece of fabric. The two notches 75, 77 are provided to properly orient the fastener and to ensure a low profile when closed. When the button-type fastener is closed, the tab member 71 fits within the notch 75 and the external attachment means 73 fits within the notch 77. The button-type fastener is opened by pulling on the tab member 71 in a direction perpendicular to the magnetic surfaces (only 76 is shown); the inserting member 72 will pivot on the means for attachment 73 where it passes through the notch 77. The body of means for attachment 77 extends below the notch 77 and acts as part of a pivot lever to aid in opening the fastener.

Figure 5:
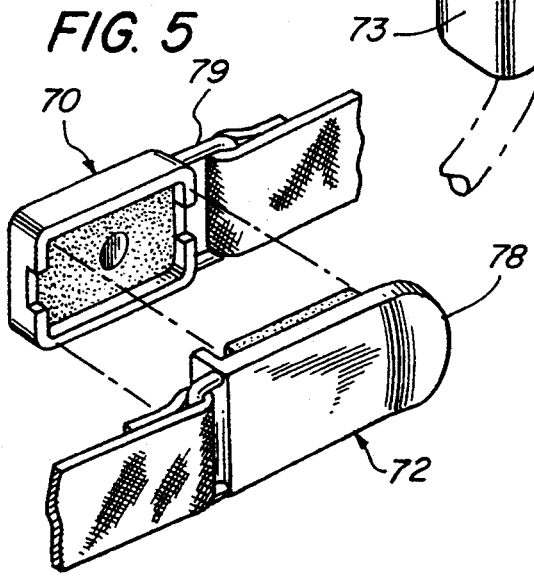
FIG. 5 is a perspective view of the present invention used as a belt buckle.

A substantially similar fastener is shown in FIG. 5 as a belt buckle. Here the rivet 74 of FIG. 4 is replaced by a loop 79 for the attachment of one end of a belt. A similar loop-like attachment means is present on the inserting member 72 for the attachment of the other end of the belt. The belt is closed by inserting the inserting member 72 into the receiving member 70. The belt is opened by flipping motion away from one's body applied to a tab member 78.

Figure 3:
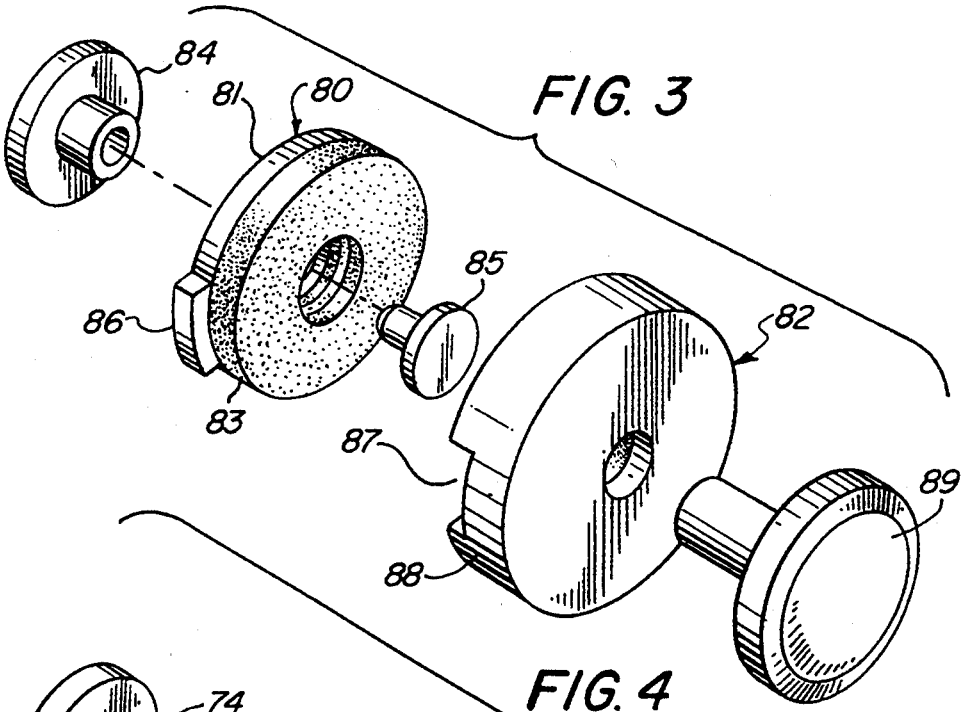
FIG. 3 is a perspective view of the present invention used as a button-type fastener.

FIG. 3 shows a second preferred embodiment of a button-type fastener. In this case, a receiving member 82 is disposed on top of an inserting member 80. It has already been explained that the relative positions of the two members can be readily interchanged. A rivet 84 serves as the external attachment means of the inserting member 80. This rivet serves to attach a base member 81 to the fabric (not shown) which is thus sandwiched between the inserting member 80 and the rivet 84. The rivet 84 also passes through a hole in a magnetic wafer 83, thereby attaching it to the base member 81. Attachment can be achieved either through the insertion of a secondary rivet 85 into a hollow in the stem of rivet 84 or, alternatively, the stem of rivet 84 can be expanded mechanically so that it cannot be withdrawn. This embodiment shows the magnetic wafer 83 and the base 81 sized to fit within the recess of the receiving member 82. Only a tab member 86 protrudes. A rivet 89 serves as the means for external attachment for the receiving member 82. Again, the receiving member 82 is attached to a piece of fabric (not shown) which is sandwiched between the receiving member 82 and the rivet 89. The head of the rivet 89 serves as a decorative button since it alone is visible when the fastener is closed. The receiving member 82 is sized to cover the inserting member 80 with the tab member 86 fitting into a notch 87 in a wall 88 of the receiving member 82. The fastener is closed by bringing the receiving member 82 and the inserting member 80 together. The tab 86 provides orientation. The fastener is opened by pulling on the exposed "button" (rivet 89) while using the tip of a finger on tab member 86 to stabilize the inserting member.

Although I have described my invention considerable detail in this specification, it will be appreciated that modifications of the device may be practiced so long as any modifications made do not exceed the scope of the appended claims.

What is claimed is:

1. A magnetic fastener comprising:

a receiving member having a base, a wall substantially perpendicular to the base and extending around the periphery of the base to create a recessed area, a notch in the wall, and a first means for external attachment substantially opposite the notch;

an inserting member, having a base substantially the same size and shape as the recessed area of the receiving member and having a tab, the tab fitting within the notch of the receiving member, an end surface of the tab projecting through the notch providing means for external attachment; and two substantially flat contacting surfaces of magnetic material, at least one of which surfaces is permanently magnetized, a first contacting surface comprising a wafer of magnetic material disposed within the recess of the receiving member, and a second contacting surface comprising a wafer of magnetic material attached to the base of the inserting member and sized to fit within the recess of the receiving unit, so that the inserting member can be inserted into the receiving member, with the contacting surfaces held together by magnetic attraction and the tab projecting through the notch, allowing said members to be separated by a force perpendicular to the contacting surfaces applied by holding the receiving member and grasping the tab.

2. The fastener of claim 1 wherein the tab is oriented perpendicular to the base and is substantially the same height as the wall of the receiving member.

3. The fastener of claim 1 wherein the first contacting surface is attached with a screw, and the second contacting surface is attached with a screw.

4. The fastener of claim 1 wherein the first contacting surface is attached with a rivet, and the second contacting surface is attached with a rivet.

5. A magnetic fastener comprising:

a receiving member having a base, a wall substantially perpendicular to the base and extending around the periphery of the base to create a recessed area, two straight notches in the wall, and means for external attachment to an item to be fastened;

an inserting member, having a base substantially the same size and shape as the recessed area of the receiving member, having a tab, the tab sized for fitting within a first notch of the receiving member wall, an end surface of the tab projecting through said notch and functioning to allow manual separation of the fastener and having means for external attachment to the item to be fastened, said means for attachment sized for fitting through a second notch in the wall of the receiving member; and two, substantially flat contacting surfaces of magnetic material, at least one of which surfaces is permanently magnetized, a first contacting surface comprising a wafer of magnetic material and disposed within the recessed area of the receiving member, and a second contacting surface comprising a wafer of magnetic material attached to the base of the inserting member and sized to fit within the recess of the receiving member, so that the inserting member can be inserted into the receiving member such that the contacting surfaces are held together by magnetic attraction, and the tab and said means for external attachment fit through the notches of the wall of the receiving member.

6. The fastener of claim 5 wherein the first contacting surface is attached to the base with a rivet, the rivet also serving as the means for external attachment to the item to be fastened.

7. The fastener of claim 6 wherein the second contacting surface is attached to the base with a rivet, the rivet also serving as the means for external attachment to the item to be fastened.

8. A magnetic fastener comprising:

a receiving member having a base, a wall extending around the periphery of the base to create a recessed area, a notch in the wall, and a first means for external attachment;

an inserting member having a base substantially the same size and shape as the recessed area of the receiving member, and a second means for external attachment sized to fit within the notch of the receiving member; and two substantially flat contacting surfaces of magnetic material, at least one of which surfaces is permanently magnetized, a first contacting surface disposed within the recessed area of the receiving member, and a second contacting surface on the base of the inserting member and sized to fit within the recessed area of the receiving member with the second means for external attachment passing through the notch, so that the inserting member can be inserted into the receiving member such that the contacting surfaces are held together by magnetic attraction.

9. A magnetic fastener comprising:

a receiving member having a base, a wall substantially perpendicular to the base and extending around the periphery of the base to create a recessed area, and two straight notches through the wall;

an inserting member, having a base substantially the same size and shape as the recessed area of the receiving member and having two projections, each projection sized and disposed to fit into one of the notches of the receiving member with an end surface of each projection projecting therethrough to provide a means for external attachment; and two substantially flat contacting surfaces of magnetic material, at least one of which surfaces is permanently magnetized, a first contacting surface disposed within the recessed area of the receiving member; and a second contacting surface attached to the base of the inserting member and sized to fit within the recessed area of the receiving member, so that the inserting member can be inserted into the receiving member such that the contacting surfaces are held together by magnetic attraction with the projections fitting within, and projecting through, the notches in the wall of the receiving member.

10. A magnetic fastener comprising:

a receiving member having a base, a wall extending around the periphery of the base to create a recessed area, and a straight notch through the wall;

an inserting member having a base substantially the size and shape as the recessed area of the receiving member, and having a projection sized and positioned to fit into the notch in the receiving member with an end surface of the projection projecting through the straight notch functioning to allow manual separation of the fastener; and two substantially flat contacting surfaces of magnetic material, at least one of which surfaces is permanently magnetized, a first contacting surface disposed within the recessed area of the of the receiving member, and a second contacting surface on the base of the inserting member and sized to fit within the recessed area of the receiving member, so that the inserting member can be inserted into the receiving member with the contacting surfaces held together by magnetic attraction.

11. The fastener of claim 10 wherein the first contacting surface is attached to the receiving member with a rivet, the rivet also serving to connect the receiving member to a first external object, and the second contacting surface is attached to the inserting member with a rivet, the rivet also serving to connect the inserting member to a second external object.

12. The fastener of claim 10 wherein the first contacting surface comprises a wafer of magnetic material attached to the base of the receiving member, and the second contacting surface comprises a wafer of magnetic material attached to the base of the inserting member.

13. The fastener of claim 12 wherein the first contacting surface is attached with a screw, and the second contacting surface is attached with a screw.

14. The fastener of claim 12 wherein the first contacting surface is attached with a rivet, and the second contacting surface is attached with a rivet.

* * * * *